US007849827B2

(12) United States Patent
Purcilly et al.

(10) Patent No.: US 7,849,827 B2
(45) Date of Patent: Dec. 14, 2010

(54) ENGINE AND METHOD OF ASSEMBLING AN ENGINE

(75) Inventors: Gregg T. Purcilly, Troy, MI (US); Edward R. Romblom, Dewitt, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 408 days.

(21) Appl. No.: 12/033,473

(22) Filed: Feb. 19, 2008

(65) Prior Publication Data

US 2009/0044772 A1 Feb. 19, 2009

Related U.S. Application Data

(60) Provisional application No. 60/955,922, filed on Aug. 15, 2007.

(51) Int. Cl.
*F01L 1/02* (2006.01)

(52) U.S. Cl. ..... 123/90.31; 123/90.17; 29/468

(58) Field of Classification Search ..... 123/90.31, 123/90.17, 376; 29/468
See application file for complete search history.

(56) References Cited

U.S. PATENT DOCUMENTS 6,289,860 B1 * 9/2001 Speckhart et al. ..... 123/90.15

* cited by examiner

*Primary Examiner*—Zelalem Eshete
(74) *Attorney, Agent, or Firm*—Quinn Law Group, PLLC

(57) ABSTRACT

An engine is provided with features allowing a method of assembly that combines the ease of assembly of a net-assembled system with the positional accuracy of an index-assembled system in order to meet critical valve to piston clearance requirements, especially critical in a diesel engine.

10 Claims, 6 Drawing Sheets

ENGINE AND METHOD OF ASSEMBLING AN ENGINE

CROSS-REFERENCE TO RELATED APPLICATIONS

This application claims the benefit of U.S. Provisional Application No. 60/955,922, filed Aug. 15, 2007, which is hereby incorporated by reference in its entirety.

TECHNICAL FIELD

The invention relates to an engine, such as a diesel engine, having a camshaft drive system with one component that has an angular adjustment feature, allowing an improved method of assembly.

BACKGROUND OF THE INVENTION

Camshafts in a vehicle engine are often driven by timing chains and a drive sprocket or sprockets (or gears) off the front of the crankshaft, or off the front of an idler/balance shaft in some engine designs. Chain guides, tensioner arms and tensioning devices (which may be hydraulic or spring actuated) are used to maintain chain tension. A respective driven sprocket is attached for rotation with each camshaft and is driven rotationally by a timing chain. The camshafts control the opening and closing motion of engine valves that regulate airflow into and out of engine cylinders. The airflow is created by the upward and downward motion of pistons that is generated by the rotary motion of the crankshaft converted to linear motion by connecting rods.

The timing of the opening and closing of the engine valves in relation to the crankshaft is critical due to a typically low clearance of the pistons to the intake valves when opening and to the exhaust valves when closing. To accommodate this tight clearance, gasoline engines often have valve relief pockets cast or machined into the pistons to provide additional valve to piston clearance. Diesel engines have significantly higher compression ratios, with most of the volume of the combustion chamber in the crown of the piston. A machined or cast valve relief pocket puts a stress concentration in the crown area of the piston. Therefore, to maintain control of the combustion chamber volume and eliminate a piston stress concentration, diesel engines minimize the size of, or do not use valve relief pockets. This requires a lower running clearance between the pistons and valves. Diesel engines must therefore be designed and assembled to attain such a precise clearance.

SUMMARY OF THE INVENTION

A method of assembling an engine drive system, especially for a diesel engine, is provided that combines the ease of assembly of a net-assembled system with the positional accuracy of an index-assembled system in order to meet a critical valve to cylinder clearance. "Net assembly" of a camshaft drive system uses locating features (also referred to herein as positioning features, marking features, identifiers or alignment features) to angularly locate and fix members of the drive system to one another, without "locking" the positions of any of the components (i.e., without holding any of the components in a set angular position, without allowing rotation, until the assembly is completed). A net assembly method is relatively easy because of the locating features, but the accuracy of the relative angular positions of the crankshaft and the camshaft (i.e., the timing of the engine) is influenced by stack-up of the tolerances (i.e., variances in the positions) of the many components in the drive system, such as the crankshaft, camshaft, timing chains, etc. The accuracy of the net assembly method is suitable for a gasoline engine, with its typically larger minimum valve to piston clearance allowance.

"Index-assembly" of a camshaft drive system involves locking the crankshaft in a set angular position and also locking the camshaft in a set angular position. The accuracy of the relative angular positions of the crankshaft and the camshaft is generally higher than with net assembly, as only the tolerances of the locking features used to lock the crankshaft and the camshaft influence the accuracy, and the locking feature tolerances are greatly reduced in comparison to the many positional tolerances influencing accuracy in the net assembly method. However, an index assembly method is more difficult and time consuming, as locating features are not provided to aid in alignment of the components.

Thus, a method of assembling an engine, and specifically a method of assembling an engine drive system for an engine, are provided.

The method of assembling an engine includes locking a driveshaft in a first predetermined angular position and locking a camshaft in a second predetermined angular position. The method also includes installing a timing drive to operatively connect the driveshaft and the camshaft. Installing the timing drive involves many substeps, such as fixing a drive sprocket to the driveshaft to prevent rotation of the drive sprocket with respect to the driveshaft. Furthermore, installing the timing drive includes piloting a driven sprocket on the camshaft without preventing relative rotation thereof (i.e., such that the driven sprocket is free to rotate relative to the camshaft). The driven sprocket has an adjustment feature. Predetermined marked identifiers on a drive chain are then aligned with location identifiers on the sprockets to position the drive chain on the sprockets. The angular position of the driven sprocket relative to the camshaft is then adjusted to align the adjustment feature with a locking feature on the camshaft gear. The driven sprocket is then locked to the camshaft gear to prevent rotation of the driven sprocket relative to the camshaft gear.

The method of assembling an engine drive system includes locking the angular positions of the engine crankshaft and the camshaft (or camshafts) using locking features. Multiple rotatable members, such as sprockets and a timing chain, operatively connect the crankshaft for driving the camshafts. The relative orientation of all but one of the multiple rotatable members is fixed using locating features so that only that single member is adjustable to vary an angular position relative to the other members. The adjustable member is adjusted in angular position to align with one of the fixed members. The adjustable member is then connected to the fixed member it is aligned with to complete the drive system assembly. The locating features afford the ease of assembly of an "index assembly" method. The locking features ensure the positional accuracy of the "net assembly" method. The adjustment feature provides adjustability of one of the components relative to a locating feature on an adjacent component, preferably of the last component to be fixed in angular position, to ensure that the relative alignment of these last two components to be connected with one another may be realized.

An engine that may be assembled according to the above method includes a driveshaft operable for reciprocally driving pistons. Complementary locking features permit the driveshaft to be selectively locked in a fixed angular position with respect to an engine block that supports the driveshaft. Within the scope of the invention, the driveshaft may be a crankshaft or a balance transfer shaft driven by the crankshaft and rotating in a predetermined geared ratio with respect thereto. The engine further includes a camshaft operable for reciprocally moving engine valves to open and close compression chambers in which the pistons move. The camshaft has a camshaft gear connected for common rotation therewith. Other complementary locking features allow the camshaft to be selectively operatively locked to a cylinder head supporting the engine valves to thereby lock the angular position of the camshaft.

A drive sprocket is fixed to the end of the driveshaft and has an angular locating feature matable with a complementary locating feature on the driveshaft to prevent relative angular displacement therebetween. A driven sprocket is selectively lockable to the camshaft gear, using an adjustment feature discussed below, to prevent relative angular displacement therebetween.

The engine further includes a timing chain. The drive sprocket and the driven sprocket have respective marking features alignable with complementary marking features on the timing chain to position the timing chain on the sprockets in a predetermined relative position when the driveshaft and camshaft are locked. Finally, the adjustment feature of the driven sprocket, such as elongated slots in the sprocket, enables angular adjustment of the driven sprocket to properly align the adjustment feature with a locating feature on the camshaft gear, such as a series of apertures, prior to locking the driven sprocket to the camshaft gear. The driven sprocket may be locked to the camshaft gear by inserting a fastener through the aligned adjustment feature and locating feature when the driveshaft and camshaft are locked and the timing chain is positioned on the sprockets in the predetermined relative position.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
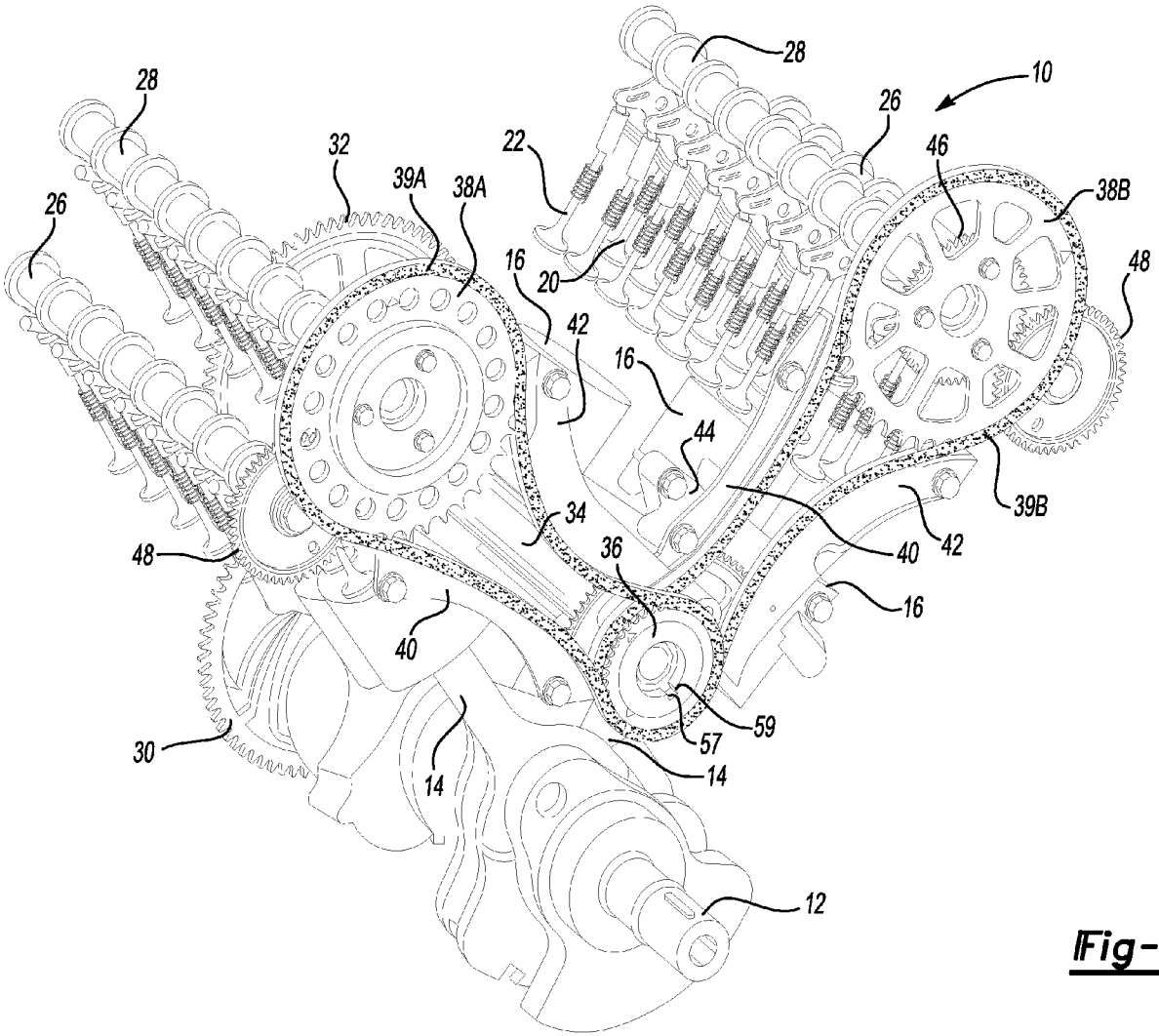
FIG. 1 is a schematic perspective illustration of a diesel engine within the scope of the invention, assembled according to the method described herein.
Figure 7:
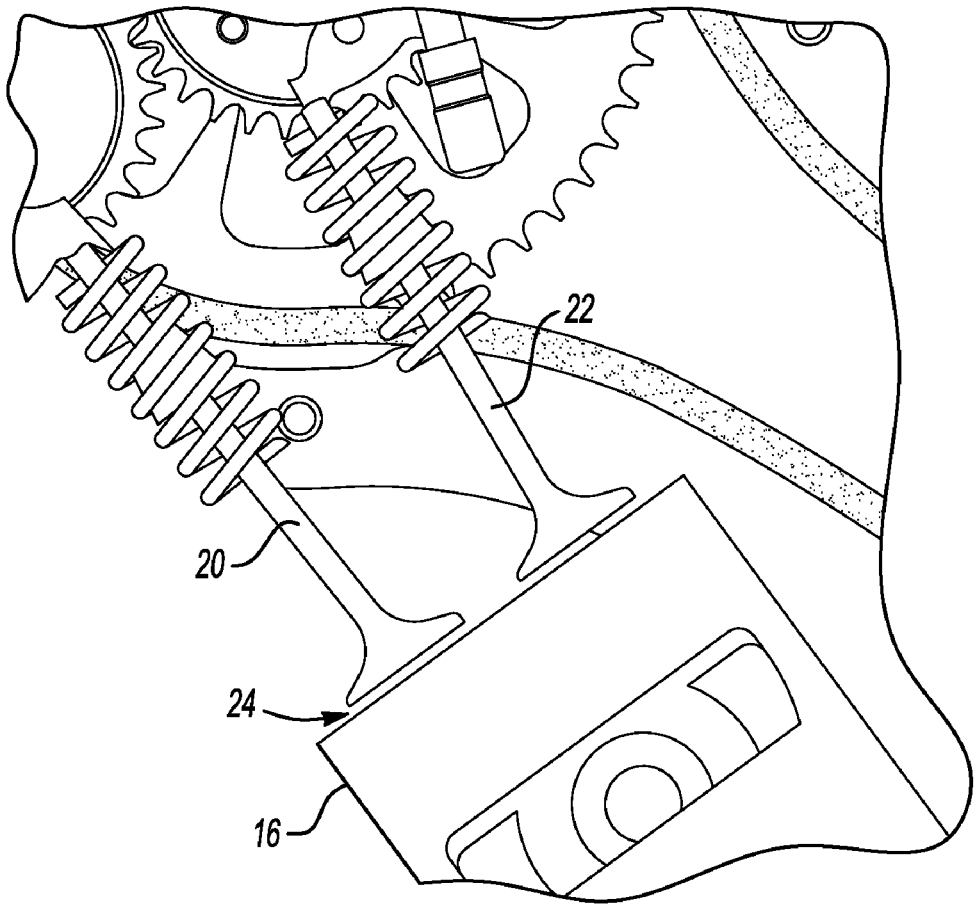
FIG. 7 is a schematic front illustration in fragmentary view of an intake and an exhaust valve of FIG. 1 operatively positioned adjacent the head of a piston to define a clearance therebetween.

Referring to the drawings, wherein like reference numbers refer to like components, FIG. 1 shows a diesel engine 10 with a rotatable crankshaft 12. Rotary motion of the crankshaft 12 is converted to linear motion of connecting rods 14, as is known. Pistons 16 are connected at the ends of the connecting rods 14 and travel within cylinder bores in an engine block 18 (not shown in FIG. 1, but shown in fragmentary view in FIG. 2). Air intake into each cylinder bore is controlled by the opening and closing of intake and exhaust valves 20, 22, respectively, best shown in FIG. 7. As is apparent in FIG. 7, the clearance 24 between the respective valves 20, 22 and each piston 16 is relatively tight. Thus, the timing of the opening and closing of the valves 20, 22 with relation to the travel of the piston 16 is critical. This timing is a function of the angular orientation of intake camshafts 26 and exhaust camshafts 28, which affect lowering and lifting of the valves 20, 22, respectively, with respect to the angular orientation of the crankshaft 12, which in turn affects the linear motion of the pistons 16.

The camshafts 26, 28 are driven by rotation of the crankshaft 12. A transfer gear set includes a gear 30 connected for rotation with the crankshaft 12 and intermeshing with a gear 32 that is concentric for rotation with a balance transfer shaft 34 and is arranged generally parallel with an axis of rotation of the crankshaft 12. A drive sprocket 36 is connected for common rotation with the balance transfer shaft 34. The drive sprocket 36 transfers rotary motion of the balance transfer shaft 34 to respective driven sprockets 38A, 38B connected for rotation with the exhaust camshafts 28 via timing chains 39A, 39B, as further described below. Chain guides 40, and tensioner arms 42 adjustable by tensioner devices 44 (which may be spring-actuated, hydraulically-actuated, or actuated by any other means known to those skilled in the art) are used to properly tension the timing chains 39A, 39B. The drive sprocket 36, timing chains 39A, 39B, driven sprockets 38A, 38B, and camshaft gears 46, 48 are referred to herein as multiple rotary members constituting a timing drive or drive system to transfer rotary motion from the balance transfer shaft 34 to the camshafts 26, 28.

Exhaust camshaft gears 46 (only one visible in FIG. 1) are fastened to the driven sprockets 38A, 38B and fixed for rotation with the exhaust camshafts 28, as further described below. The exhaust camshaft gears 46 intermesh with intake camshaft gears 48 fixed for rotation with the intake camshafts 26 to further transfer rotary motion to the intake camshafts 26.

Figure 2:
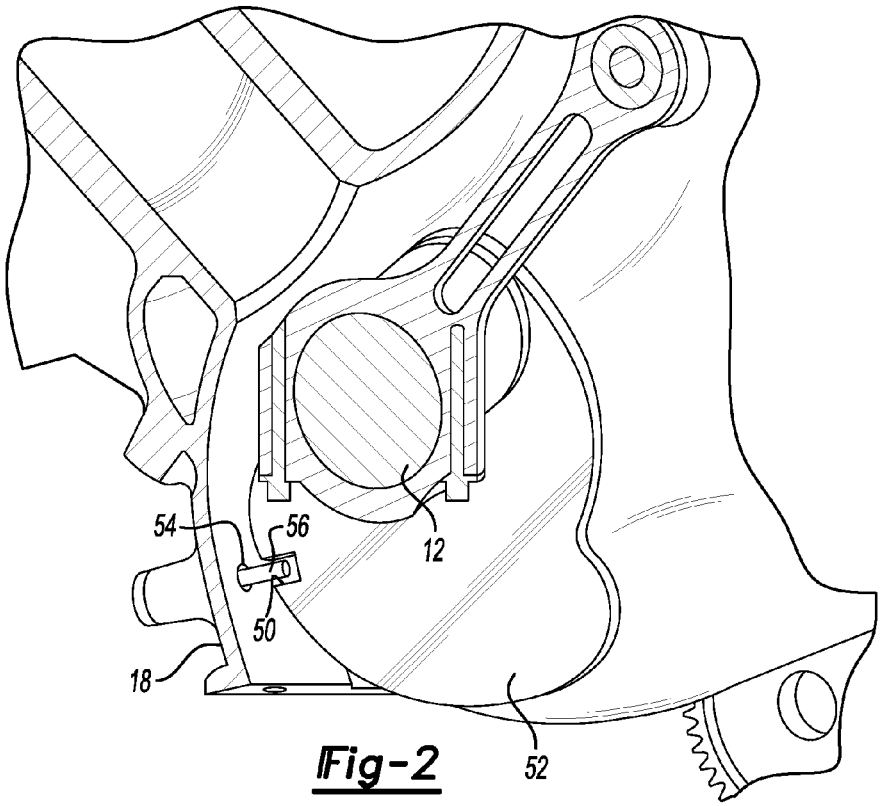
FIG. 2 is a schematic perspective illustration in fragmentary partial cross-sectional view of a crankshaft counterweight lockable to the engine block of the engine of FIG. 1 to lock respective angular positions of the crankshaft and balance transfer shaft.

In order to reliably attain the appropriate timing and ensure the required valve clearance 24 (see FIG. 7), the engine 10 is designed with and assembled using a combination of both "net build" and "index build" assembly features. First, as best shown in FIG. 2, the crankshaft 12 is locked in a predetermined angular position by aligning a locking feature 50 of the crankshaft 12, with a complementary locking feature 54 in the engine block 18. The complementary locking feature 50 is a key opening in a crankshaft counterweight 52. The complementary locking feature 54 is a fastener opening in the engine block 18. A locking pin 56, shown in phantom, is inserted through the engine block 18 and the aligned locking features 50, 54 to lock the crankshaft 12 in the predetermined angular position associated with the locked position of the counterweight 52. Because the balance transfer shaft 34 is driven by the crankshaft 12 through the transfer gear set 30, 32, the locking features 50, 54 and pin 56 also lock the balance transfer shaft 34.

Figure 4A:
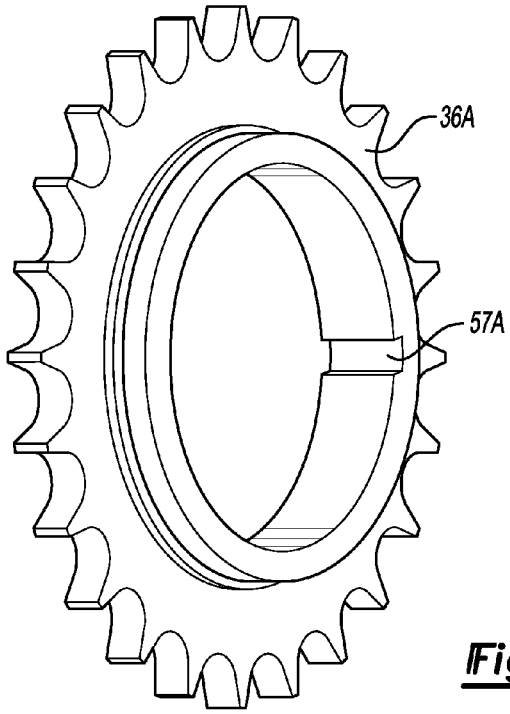
FIG. 4A is a schematic perspective illustration of a drive sprocket having a key slot serving as a positioning feature to fix the drive sprocket angular position relative to a key on the crankshaft, similar to the keyed balance transfer shaft of FIG. 1 on which a drive sprocket with a key slot is fixed.
Figure 4B:
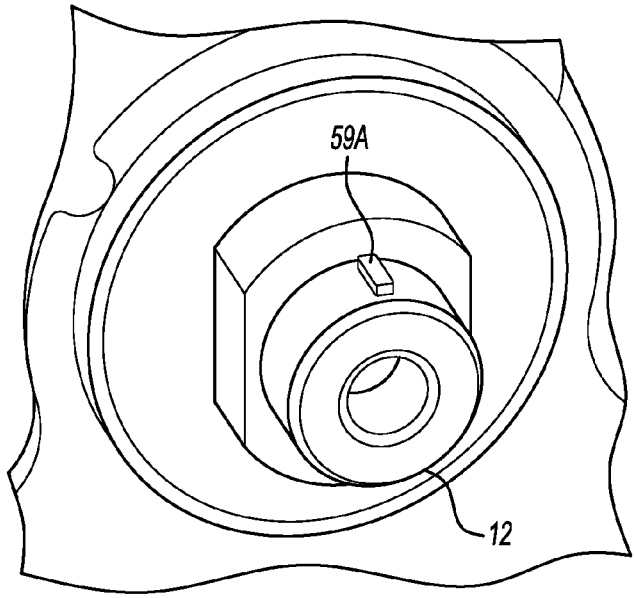
FIG. 4B is schematic perspective illustration in fragmentary view of the crankshaft having a key to accept the drive sprocket of FIG. 4A for an embodiment of an engine drive system in which the drive sprocket is fixed to the crankshaft rather than the balance transfer shaft.

Next, referring to FIG. 1, the drive sprocket 36 is fixed to the locked balance transfer shaft, also in a predetermined angular position, by aligning an angular positioning feature 57 of the drive sprocket 36, which is a keyed opening, with a complementary positioning feature 59 of the balance transfer shaft 34, which is a key. Similar features are illustrated in FIGS. 4A and 4B, which show fixing of a drive sprocket 36A to the crankshaft 12, assuming an embodiment in which the crankshaft 12 rather than a balance transfer shaft 34 drives the timing chains 39A, 39B. In that embodiment, a keyed opening 57A is aligned with a key 59A of the crankshaft 12.

Figure 3A:
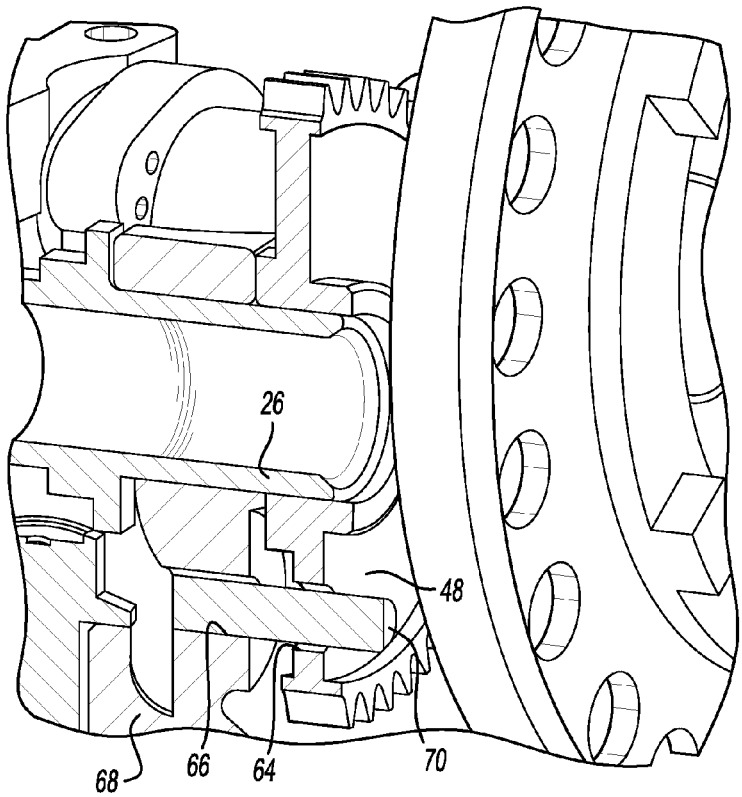
FIG. 3A is a schematic perspective illustration in fragmentary view of an intake camshaft gear locked to a cylinder head of the engine of FIG. 1 to lock respective angular positions of the intake and exhaust camshafts.
Figure 3B:
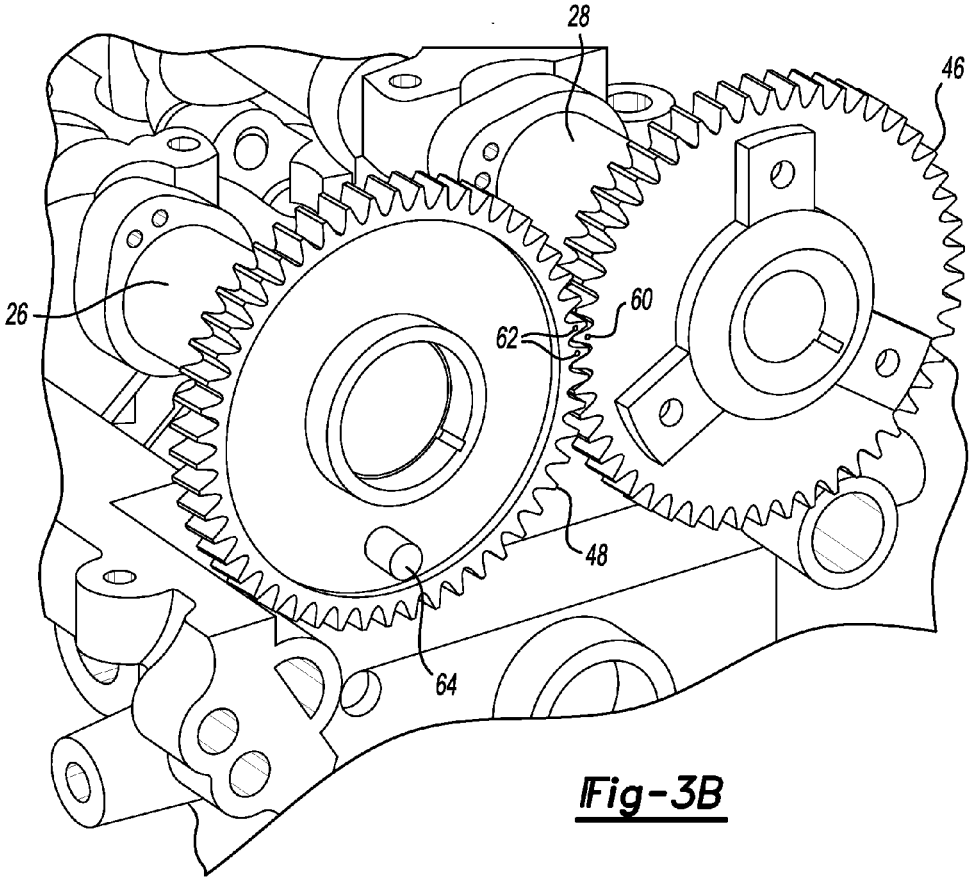
FIG. 3B is a schematic perspective illustration in fragmentary partial cross-sectional view of the locked intake camshaft gear intermeshing with and locking an exhaust camshaft gear.

Next, referring again to FIG. 1, the camshafts 26, 28 are locked in desired angular positions relative to the locked angular position of the crankshaft 12. This is accomplished by first fixing the intake camshaft gears 48 to the intake camshafts 26 using a key and keyed opening arrangement similar to that used to fix the drive sprocket 36 to the balance transfer shaft 34. Then the exhaust camshaft gears 46 are piloted on the ends of the exhaust camshafts 28, also using a key and keyed opening arrangement. As best shown in FIG. 3B, a marking feature 60 on each exhaust camshaft gear 46 (e.g., gear teeth marked with a slight indentation, a color marking, or the like), is aligned with a complementary marking feature 62 (also marked teeth) on the adjacent, intermeshing intake camshaft gear 48. Referring to FIG. 3A, a locking feature 64, which is an opening through the intake camshaft gear 48 is then aligned with a complementary locking feature 66, which is an opening in the cylinder head 68. A locking pin 70 is then inserted through the aligned locking features 64, 66 to temporarily lock the intake camshaft gears 48 and the intake camshafts 26 to the stationary cylinder head 68 in the predetermined angular position established by the marking features 60, 62 and the locking features 64, 66. Because the exhaust camshaft gears 46 mesh with the intake camshaft gears 48 (as shown in FIG. 1), the exhaust camshaft gears 46 and exhaust camshafts 28 are also locked in a predetermined angular position.

Figure 5:
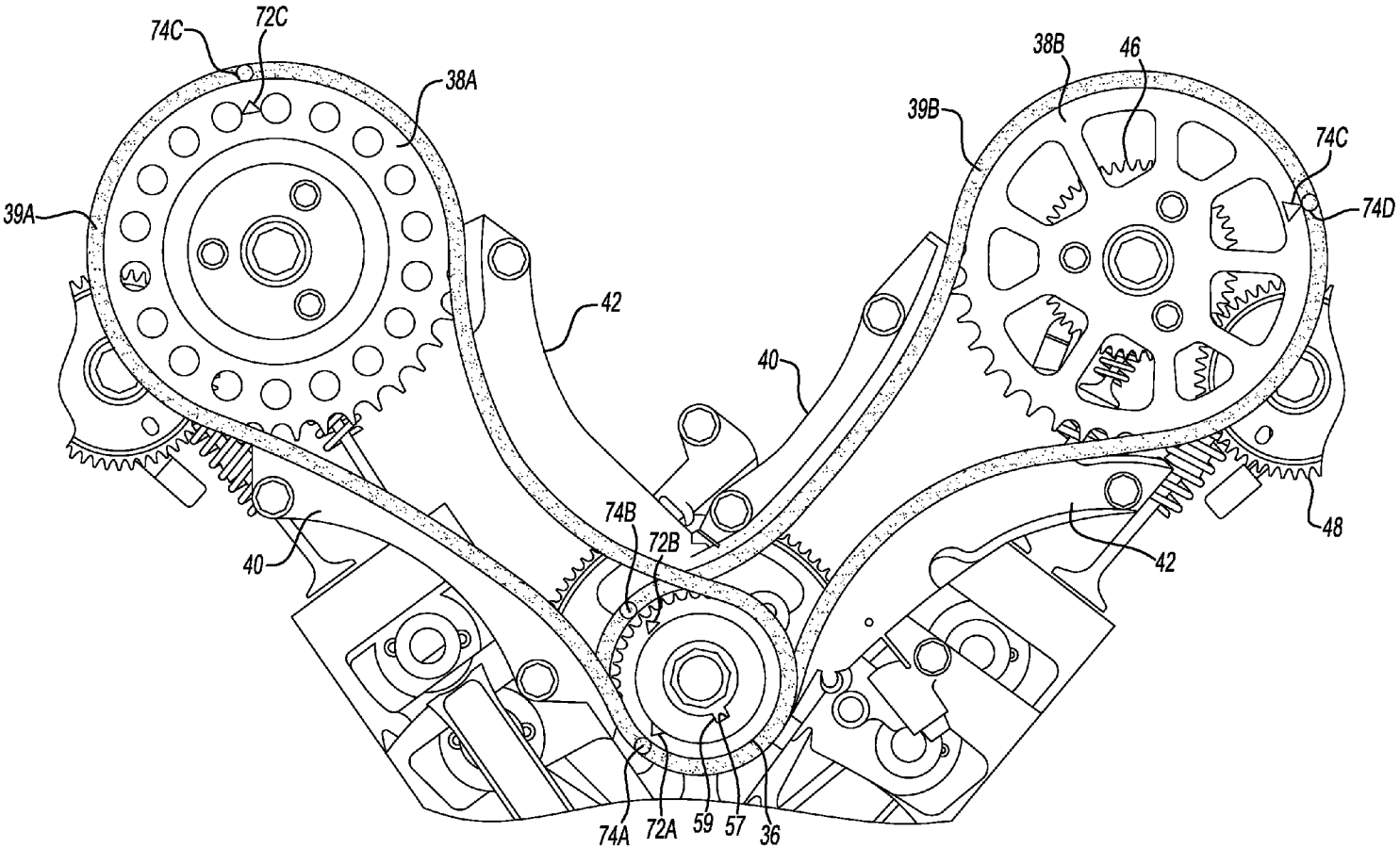
FIG. 5 is a schematic illustration in front fragmentary view of the engine of FIG. 1, showing marking features on the timing chains located with respect to complementary marking features on the drive sprocket and the driven sprockets.

Referring now to FIG. 1, with the crankshaft 12, balance transfer shaft 34 and camshafts 26, 28 all locked in set angular positions, the driven sprockets 38A, 38B are then piloted on to the ends of the exhaust camshafts 28, but temporarily not fixed or locked in angular relation to the exhaust camshafts 28. The timing chains 39A, 39B are then positioned over the drive sprocket 36 and the driven sprockets 38A, 38B between the chain guides 40 and the tensioner arms 42. The drive sprocket 36 has two sets of circumferential teeth, spaced axially from one another, with a front set driving timing chain 39A and a rear set driving timing chain 39B (and obscured by the timing chain 39B in FIG. 1). Referring to FIG. 5, the drive sprocket 36 and driven sprockets 38A, 38B have location identifiers 72A, 72B, 72C and 72D, also referred to as marking features or positioning features, in the form of marked teeth, indicated by arrows in FIG. 5, that are similar to the marking features 60, 62 of the camshaft gears 46, 48. The timing chains 39A, 39B have complementary marking features 74A, 74B, 74C, 74D, in the form of marked links, shown with circular markings in FIG. 5, which are aligned with the respective marking features 72A, 72B, 72C and 72D when the timing chains 39A, 39B are installed. The tensioner arms 42 are then set to ensure the marking features 72A-72D and 74A-74D remain in alignment with one another.

Figure 6:
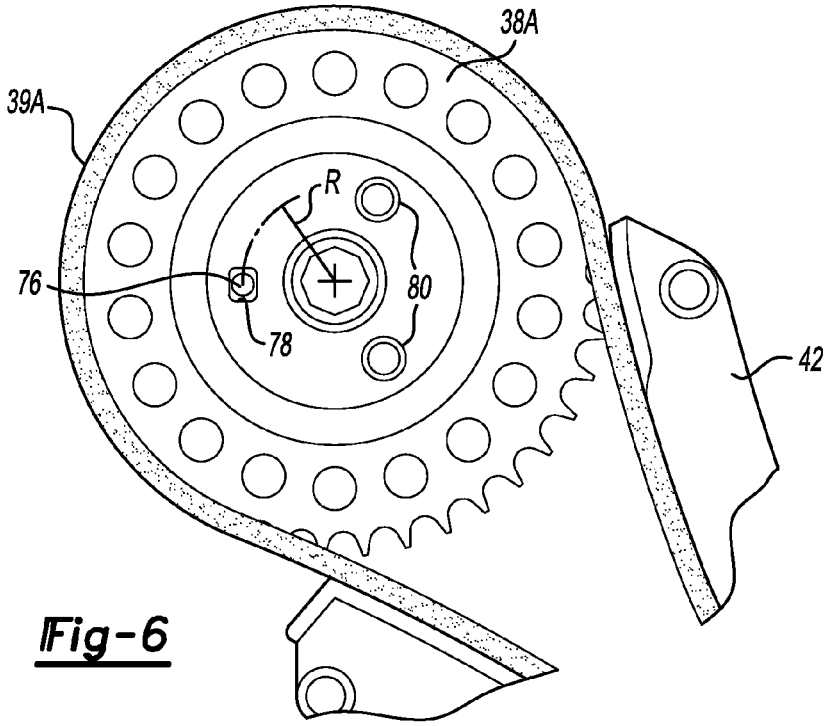
FIG. 6 is a schematic illustration in front fragmentary view of one of the driven sprockets of FIG. 1 having an adjustment feature aligned with a locating feature in the exhaust camshaft gear to allow the driven sprocket to be fixed to the exhaust camshaft gear and exhaust camshaft for rotation therewith.

Finally, the angular orientation of the driven sprockets 38A, 38B is matched to the locked angular orientation of the exhaust camshaft gears 46 by rotating the driven sprockets 38A, 38B relative to the respective exhaust camshaft gears 46 as necessary to align the driven sprockets 38A, 38B with a locking feature 76 of the exhaust camshaft gears 46 (locking feature 76 of the camshaft gear 46 associated with drive sprocket 38A is shown in FIG. 6). The locking feature 76 is a series of spaced apertures at a predetermined radial distance R from the center of rotation of the exhaust camshaft gears 46, as illustrated in FIG. 6. An adjustment feature 78 in the driven sprockets 38A, 38B, which is a series of elongated slots in the driven sprockets 38A, 38B also at the predetermined radial location R (shown in FIG. 6 with respect to driven sprocket 38A), serves as an indexing feature in that it allows the driven sprockets 38A, 38B to be adjusted prior to locking the driven sprockets 38A, 38B to the exhaust camshaft gears 46 by inserting fasteners 80 through the aligned locking features 76 (apertures) and adjustment features 78 (slots) so that the locked angular orientations of the crankshaft 12, balance transfer shaft 34 and camshafts 26, 28, as well as the aligned marking features 72A-72D and 74A-74D of the sprockets 36, 38A, 38B to timing chains 39A, 39B are maintained and tolerance stack-ups in the various components of the drive system are accommodated. In FIG. 6, one of the fasteners 80 is removed to show the aperture 76 and the slot 78; other respective aligned apertures and slots are hidden by the fasteners 80 that are shown.

While the best modes for carrying out the invention have been described in detail, those familiar with the art to which this invention relates will recognize various alternative designs and embodiments for practicing the invention within the scope of the appended claims.

The invention claimed is:

1. A method of assembling an engine drive system having a crankshaft operable for moving pistons in a reciprocal fashion, having an engine-driven camshaft operable for controlling the reciprocal movement of engine valves, and having multiple rotatable members operatively connecting the crankshaft with the camshaft, comprising:

locking the angular positions of the crankshaft and the camshaft;

fixing the relative angular orientation of a number of the multiple rotatable members operatively connecting the crankshaft and the camshaft such that one of the multiple rotatable members is movable to vary an angular position relative to the fixed ones of the multiple rotatable members; and after the locking and fixing, adjusting the angular position of the movable one of the rotatable members to align with a fixed one of the rotatable members, and connecting the adjusted one of the rotatable members to the fixed one of the rotatable members for common rotation therewith, thereby determining a minimum clearance between the respective engine valves and pistons when the crankshaft and camshaft are unlocked and the engine is on.

2. The method of assembling an engine drive system of claim 1, wherein after the locking and fixing, only the angular position of the movable one of the multiple rotatable members is adjustable relative to all other of the multiple rotatable members operatively connecting the crankshaft and the camshaft such that the method is characterized by an absence of adjusting the angular position of any other of the multiple rotatable members operatively connecting the crankshaft and the camshaft.

3. The method of assembling an engine drive system of claim 1, wherein the camshaft is a first camshaft, the pistons are a first set of pistons and the engine valves are a first set of engine valves; wherein the crankshaft is operable for reciprocally moving a second set of pistons when the crankshaft is unlocked and the engine is on; wherein the adjusted one of the rotatable members is a first driven sprocket and the fixed one of the rotatable members that the adjusted one is connected to is a camshaft gear on the first camshaft; wherein the engine drive system further includes a second camshaft operable for controlling the reciprocal movement of a second set of engine valves operatively connected with the crankshaft by additional rotatable members; and further comprising:

locking the angular position of the second camshaft;

fixing the relative angular orientation of a number of the additional rotatable members operatively connecting the crankshaft and the second camshaft such that one of the additional rotatable members is movable to vary an angular position relative to the fixed ones of the additional rotatable members; and after the locking the angular position of the second camshaft and fixing the relative angular orientation of a number of the other rotatable members operatively connecting the crankshaft and the second camshaft, adjusting an angular position of the movable one of the additional rotatable members to align with a fixed one of the additional rotatable, and connecting the adjusted one of the additional rotatable members to the fixed one of the additional rotatable members for common rotation therewith, thereby determining a minimum clearance between the respective second set of engine valves and second set of pistons when the crankshaft and the second camshaft are unlocked and the engine is on.

4. A method of assembling a diesel engine having a driveshaft and a camshaft with a camshaft gear concentric therewith, comprising:

locking the driveshaft in a first predetermined angular position;

locking the camshaft in a second predetermined angular position; and installing a timing drive to operatively connect the driveshaft and the camshaft by:

fixing a drive sprocket to the driveshaft to prevent relative rotation thereof, piloting a driven sprocket on the camshaft without preventing relative rotation thereof, wherein the driven sprocket includes an adjustment feature;

aligning predetermined marked identifiers on a drive chain with location identifiers on the sprockets to position the drive chain on the sprockets;

adjusting an angular position of the driven sprocket relative to the camshaft to align the adjustment feature with a locking feature on the camshaft gear; and after the adjusting, locking the driven sprocket to the camshaft gear to prevent relative rotation thereof.

5. The method of assembly of claim 4, wherein the driveshaft is a balance shaft rotatable in fixed relation to a crankshaft; and wherein locking the driveshaft is by locking a counterweight fixed to the crankshaft to an engine block which supports the crankshaft.

6. The method of claim 4, wherein the camshaft is a first camshaft and the camshaft gear is a first camshaft gear connected for common rotation with first camshaft and intermeshing with a second camshaft gear connected for rotation with a second camshaft; and wherein locking the first camshaft is by locking the second camshaft gear to a cylinder head supporting the camshafts.

7. An engine comprising:

a driveshaft operable for reciprocally driving pistons and selectively lockable in a fixed angular position with respect to an engine block that supports the driveshaft;

a camshaft operable for reciprocally moving engine valves to open and close compression chambers defined by the engine block and in which the pistons move; wherein the camshaft has a camshaft gear connected for common rotation therewith that is selectively lockable in a fixed angular position relative to a cylinder head supporting the engine valves to thereby lock the angular position of the camshaft;

a drive sprocket connected to the driveshaft and having an angular positioning feature matable with a complementary positioning feature on the driveshaft to prevent relative angular displacement therebetween;

a driven sprocket lockable to the camshaft gear to prevent relative angular displacement therebetween;

a timing chain; wherein the drive sprocket and the driven sprocket have respective marking features alignable with complementary marking features on the timing chain to position the timing chain on the sprockets in a predetermined relative position when the driveshaft and camshaft are locked; and wherein the driven sprocket has an adjustment feature enabling angular adjustment of the driven sprocket to align with a locking feature on the camshaft gear prior to locking the driven sprocket to the camshaft gear when the driveshaft and camshaft are locked and the timing chain is positioned on the sprockets in the predetermined relative position.

8. The engine of claim 7, wherein the driveshaft is a balance shaft rotatably driven by a crankshaft in a fixed relative angular position; wherein the crankshaft has a counterweight with another locking feature alignable with a complementary locking feature of the engine block to permit locking of the crankshaft and thereby of the balance shaft in the fixed relative angular position.

9. The engine of claim 7, wherein the camshaft is a first camshaft and the camshaft gear is a first camshaft gear; and further comprising:

a second camshaft with a second camshaft gear connected for common rotation therewith and intermeshing with the first camshaft gear; and wherein the second camshaft gear has another locking feature alignable with a complementary locking feature of the cylinder head to permit locking of the second camshaft gear and thereby of both camshafts and the first camshaft gear in nonrotatable, fixed relative angular positions.

10. The engine of claim 7, wherein the adjustment feature is an elongated slot in the driven sprocket at a predetermined radial location thereon; wherein the locking feature on the camshaft gear is an aperture in the camshaft gear at the predetermined radial location; and wherein the driven sprocket is locked to the camshaft gear by a fastener extending through the aligned slot and aperture.

* * * * *